US006284102B1

(12) United States Patent
Inoue et al.

(10) Patent No.: US 6,284,102 B1
(45) Date of Patent: Sep. 4, 2001

(54) SHOE PRESS BELT AND METHOD FOR MANUFACTURING THE SAME

(75) Inventors: Hideo Inoue, Matsudo; Harushige Ikeda, Tokyo, both of (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/534,798

(22) Filed: Mar. 24, 2000

(30) Foreign Application Priority Data

Apr. 26, 1999 (JP) ..... 11-118690

(51) Int. Cl.[7] ..... D21F 3/02; B29C 53/66

(52) U.S. Cl. ..... 162/358.4; 156/172; 156/173; 156/177; 162/901; 264/258

(58) Field of Search ..... 162/358.4, 901; 428/36.2, 36.3; 198/847; 156/169, 172, 173, 177; 264/258

(56) References Cited

U.S. PATENT DOCUMENTS

| | | | | |
|---|---|---|---|---|
| 5,062,924 | | 11/1991 | McCarten et al. | 162/358 |
| 5,134,010 | | 7/1992 | Schiel | 428/113 |
| 5,525,194 | * | 6/1996 | Jermo | 162/358.4 |
| 5,968,318 | * | 10/1999 | Hasegawa et al. | 162/358.4 |
| 6,086,719 | * | 7/2000 | Hasegawa et al. | 162/358.4 |

FOREIGN PATENT DOCUMENTS

| | | |
|---|---|---|
| 64-45888 | 2/1989 | (JP) . |
| 64-45889 | 2/1989 | (JP) . |
| 1-503315 | 11/1989 | (JP) . |
| 1-298292 | 12/1989 | (JP) . |
| 3-57236 | 8/1991 | (JP) . |
| 5-505428 | 8/1993 | (JP) . |

* cited by examiner

*Primary Examiner*—Karen M. Hastings
(74) *Attorney, Agent, or Firm*—Quarles & Brady LLP

(57) ABSTRACT

A shoe press belt capable of improving flexibility in bending in the axial direction of and of inhibiting cracks in the belt where it contacts the ends of a shoe has first resin layer formed on a mandrel, a base material layer formed on the outer periphery of the first resin layer, and a second resin layer including the base material layer. The base material layer is a composite layer including an inner layer in which one or more yarn strands are wound spirally on the first resin layer in the circumferential direction, a middle layer in which a yarn strand is arranged on the inner layer generally parallel to the axial direction of the mandrel, and an outer layer in which at least one yarn strand is wound spirally on the middle layer in the circumferential direction in such a way that it does not overlap the yarn of the inner layer and crimps the yarn of the middle layer. The base material structure is responsive to compression and tension in the axial direction and is constituted so that it can improve flexibility to bending at the ends of a shoe in the axial direction by crimping the yarn of the middle layer by the yarn of the outer layer and the yarn of the inner layer.

6 Claims, 7 Drawing Sheets

SHOE PRESS BELT AND METHOD FOR MANUFACTURING THE SAME

CROSS REFERENCE TO RELATED APPLICATIONS

Not Applicable.

STATEMENT REGARDING FEDERALLY SPONSORED RESEARCH OR DEVELOPEMEMT

Not applicable.

BACKGROUND OF THE INVENTION

1. Field of the Invention

The present invention relates to a shoe press belt for making paper, and in particular, to a closed-type shoe press belt and a method for manufacturing the same.

2. Discussion of the Prior Art

The press part of a paper-making machine may be an open-type shoe press or a closed-type shoe press. Since the former open-type shoe press needs a larger installation space and has a drawback of oil scattering, the latter closed-type shoe press has been mainly used in recent years.

A closed-type shoe press is shown in FIG. 8 and FIG. 9. In the drawings, reference numeral 21 designates a press roll, reference numeral 22 designates a shoe, and reference numeral 23 designates a shoe press belt. The shoe press belt 23 is formed in an endless shape and runs with an upper felt 25 and a lower felt 25' which pinch a wet paper sheet 24, and the wet paper sheet 24 pinched between the felts is pressed by the press roll 21 and the shoe 22 to squeeze water from the wet paper sheet 24.

The shoe press belt 23 described above is moved by a press roll 21 as a drive source via the felt 25, the wet paper sheet 24 and the felt 25'. When the shoe press belt 23 is moved, it is bent to the roll side at both edges of the shoe press belt 23 extending off from both edges of the press roll 21, but it is deformed in a curve in an opposite direction in the part between edges 22*a* and 22*b* of the shoe 22 in the direction of MD, that is, in the part where it is pressed by the shoe 22 and the press roll 21. Therefore, the complicated bending applies a compressive force and a tensile force to both ends of the shoe press belt 23 inside of and outside of the boundary at both ends of the shoe 22 in the direction of CMD.

That is, in the case where the shoe press belt 23 is moved in the direction of the arrows shown in FIG. 9, there is a pressed part 23*a* (shown by hatching) and an unpressed part 23*b* (shown by blank) and a drive force is applied to the pressed part 23*a* and the unpressed part 23*b* tends to lag. Therefore, this produces stress S at the boundary parts 23*c* of the belt 23, which causes distortions and cracks.

A closed-type shoe press belt 23 having a short circumferential length (size) and hence severe usage conditions, as described above, needs to be durable, and hence is reinforced with a base fabric inserted into the thick portion of the belt. Typical examples of the closed-type shoe press belt are disclosed in Japanese Published Examined Patent Application No. 3-57236, Japanese Published Unexamined Patent Application No. 64-45888, Japanese Published Unexamined Patent Application No. 64-45889, Japanese Published Unexamined Patent Application No. 1-503315, Japanese Published Unexamined Patent Application No. 1-29892, Translation of Unexamined PCT Application No. 5-505428.

The Japanese Published Examined Patent Application No. 3-57236 discloses a shoe press belt made by mounting an endless base fabric around a mandrel and then by flowing resin thereon, that is, by a die molding method. This method has a merit of producing a uniform thickness and a smooth surface but has a problem in setting a position of the base fabric uniformity in the direction of thickness.

Further, the Japanese Published Unexamined Patent Application No. 64-45888 discloses a shoe press belt made by forming a first resin layer around a mandrel, then by putting a thermally contractible base fabric on the first resin layer, further by applying resin on the base fabric and by drying and curing the resin to form a second resin layer. This method can set a position of the base fabric uniformily in the direction of thickness, but since the base fabric used in this case is a fabric having an end, it is difficult to position the base fabric in the direction of MD and hence a pin hole might be produced.

Further, the Japanese Published Unexamined Patent Application No. 64-45889 discloses a shoe press belt made by mounting a not-yet-cured resin sheet around a mandrel, by putting a thermally contractible ground fabric on the resin sheet, further by winding a second not-yet-cured resin sheet on the base fabric, and finally by winding a ribbon made of thermally contractible resin on the second resin sheet and by thermally contracting the ribbon. Also in the case, as is the case with the Japanese Published Unexamined Patent Application No. 64-45888, since the base fabric used in this case is a fabric having an end, it is difficult to position the base fabric in the direction of MD and hence a pin hole might be produced.

Still further, the Japanese Translation of Unexamined PCT Application No. 1-503315 (U.S. Pat. No. 5,134,010) discloses a shoe press belt made by looping yarns in the axial direction of a mandrel around the whole periphery of the mandrel at constant intervals without using a fabric as a base fabric, by winding a yarn spirally thereon in the direction of MD, and then by flowing resin thereon. This method has a merit that a change in size caused by tension in the direction of CMD is made small, but has a problem that the yarns in a longitudinal direction and a yarn in the lateral direction constitute different layers and do not crimp the other yarn each other to reduce the flexibility of the base fabric and to change the center of bending in the direction of MD and in the direction of CMD, whereby bending stress applied by the bending to the obverse and reverse resin layers becomes large and trends to produce cracks at a part of the belt contacting the ends of the shoe.

Still further, the Japanese Published Unexamined Patent Application No. 1-298292, discloses a shoe press belt made by impregnating a mat-shaped fiber belt with not-yet-cured resin, by winding the fiber belt on a mandrel spirally, and by heating and curing the fiber belt. This belt has a problem that it is not stable in size in the direction of MD and in the direction of CMD and that it is apt to be separated.

Still further, the Japanese Translation of Unexamined PCT Application No. 5-505428 (U.S. Pat. No. 5,062,924) discloses a shoe press belt made by impregnating a fabric made of yarns, which have a low elastic modulus and are arranged in the direction of MD, and a yarn, which has a high elastic modulus and is wound in the direction of CMD, with not-yet-cured resin, by winding the fabric on a mandrel spirally, and by curing the fabric. This has a problem that the belt might be separated when stress is applied to a part where the fabric wound on the mandrel overlaps.

As described above, a shoe press belt and a reinforcing structure thereof produced by the conventional methods disclosed in the Japanese Published Examined Patent Application No. 3-57236 and others described above had a difficult problem that they could not show sufficient base material characteristics placing emphasis on durability required of the belt itself, and bending strength and tension in the direction of MD, which are required for a belt driven by a felt in range of the width of the belt in the direction of MD of a shoe.

SUMMARY OF THE INVENTION

The present invention has been made to solve the above problems, and it is an object of the present invention to provide a shoe press belt capable of increasing flexibility in bending in the direction of CMD and of effectively inhibiting cracks from being produced in the contacting the ends of a shoe, and a method for manufacturing the same.

In order to accomplish the above object, the present invention is formed of a first resin layer formed on a mandrel having a ground surface, a base material layer formed on the outer periphery of the first resin layer, and a second resin layer including the base material layer. The base material layer is formed of a composite layer including an inner layer in which at least one strand of yarn is wound spirally on the first resin layer in the circumferential direction (in the direction of MD=in the direction in which a belt runs), a middle layer in which at least one yarn is arranged on the inner layer in nearly parallel to the axial direction of the mandrel (in the direction of CMD), and an outer layer in which at least one strand of yarn is wound spirally on the middle layer in the circumferential direction in such a way that it does not overlap the yarn of the inner layer and crimps the yarn of the middle layer. This base material structure is responsive to compression and tension in the axial direction and is constituted so that it can improve flexibility to bending at the edges of a shoe in the axial direction by crimping the yarn of the middle layer by the yarn of the outer layer and the yarn of the inner layer.

Also, in one aspect the present invention is characterized in that the pitches of the yarns wound in the circumferential direction of the inner layer and the outer layer constituting the base material layer may change over the width of the belt, and is constituted so that it can improve the bending and tension characteristics of the base material not only in the portion contacting the shoe, but also at boundary portions between the portion contacting the shoe and the end portions not contacting the shoe.

In another aspect, the present invention is characterized in that the number of strands of yarn wound in the circumferential direction of the inner layer and the outer layer constituting the base material layer may be one or more than one, and is constituted such that it can produce high bending strength and tension in the circumferential direction by increasing the density of the yarn at the portion contacting the shoe and at the boundary portions between the portion contacting the shoe and the portions not contacting the shoe.

Still further, an aspect of the present invention is that it may be made by forming a first resin layer on a mandrel, a base material layer by winding at least one strand of yarn on the first resin layer spirally in the circumferential direction, a base material middle layer by arranging at least one strand of yarn on the inner layer nearly parallel to the axial direction of the mandrel and a base material outer layer by winding a yarn spirally in the circumferential direction in such a way that it does not overlap the yarn of the inner layer and crimps the yarn of the middle layer. A second resin layer is then formed on the base material composite layer in such a way that it includes the whole composite layer. This method can be used to easily manufacture a shoe press belt having a base material structure responsive to compression and tension in the axial direction and capable of improving flexibility to bending at the edges of a shoe in the axial direction by crimping the yarn of the middle layer with the yarn of the outer layer and the yarn of the inner layer.

The present invention is characterized in another aspect in that the pitches of the yarns wound in the circumferential direction of the inner layer and the outer constituting layer the base material layer described above may be changed across the width of the belt, and is constituted such that it can easily manufacture a shoe press belt capable of improving the bending and tensile strength characteristics of the base material in the portion contacting the shoe and at the boundary portions between the portion contacting the shoe and the end portions not contacting the shoe.

In another aspect, the present invention is characterized in that the number of strands of yarn wound in the circumferential direction of the inner layer and the outer layer constituting the base material layer may be one or more than one, and the density of yarn may be changed, so as to easily manufacture a shoe press belt capable of producing high bending strength and tension in the circumferential direction by increasing the density of the yarn at the portion contacting the shoe and at the boundary portion between the part contacting the shoe and the portions not contacting the shoe.

These and other objects and advantages of the invention will be apparent from the detailed description and drawings.

BRIEF DESCRIPTION OF THE DRAWINGS

FIG. 2 (*b*) is a cross-sectional view taken along line B—B of FIG. 1;

DETAILED DESCRIPTION OF THE PREFERRED EMBODIMENTS

Figure 1:
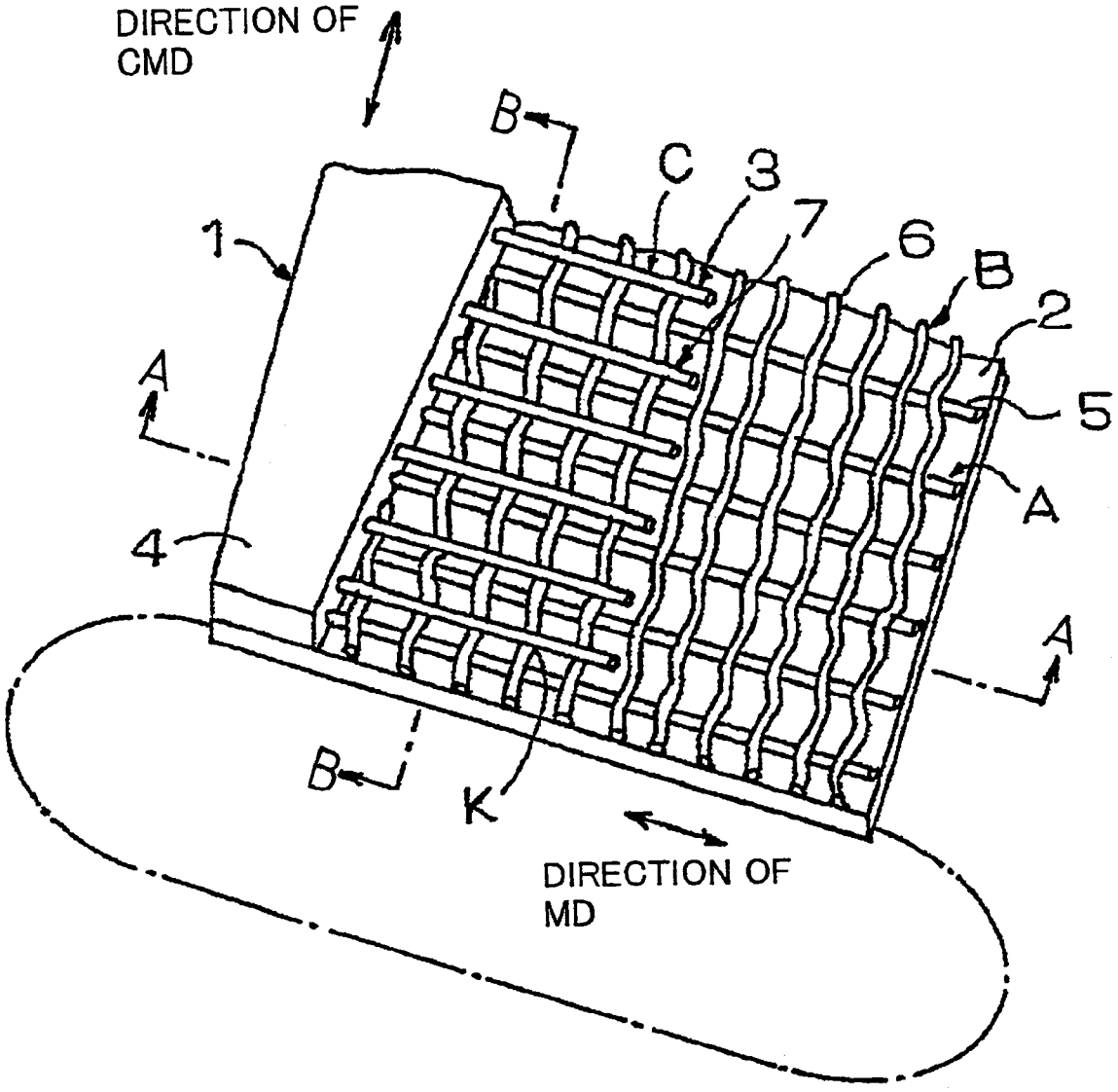
FIG. 1 is an enlarged perspective view showing a part of a belt in accordance with the present invention.

The present invention, as shown in FIG. 1, is made of a first resin layer 2 formed in an endless shape, a base material layer 3 formed on the outer periphery of the first resin 2, and a second resin layer 4 including the base material layer 3.

It is recommended that the first resin layer 2 and the second resin layer 4 be made of rubber or elastomer and more preferably, of the thermosetting polyurethane, and that the hardness thereof be selected from 80° to 98° (JIS-A). Of course, it is not necessary that the first resin layer 2 and the second resin 4 layer always have the same hardness.

The base material layer 3 is made of a composite layer including an inner layer made of a yarn 5 wound spirally on the first resin layer 2 in a circumferential direction (in the direction of MD=in the direction in which a belt runs), a middle layer B made of a yarn 6 arranged on the inner layer A nearly parallel to the axial direction of the mandrel (in the direction of CMD), and an outer layer C made of a yarn 7 wound on the middle layer B spirally in circumferential direction while crimping (K) the yarn 6 of the middle layer B such that the yarn 7 does not overlap the yarn 5 of the inner layer 5.

Figure 2A:
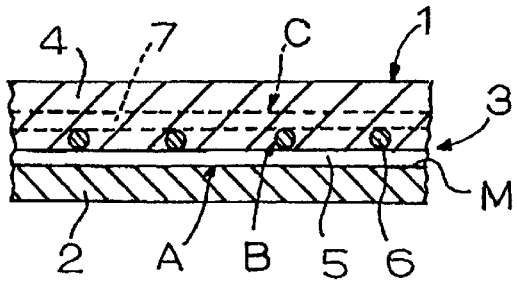
FIG. 2(*a*) is a cross-sectional view taken along line A—A of FIG. 1.
Figure 2B:
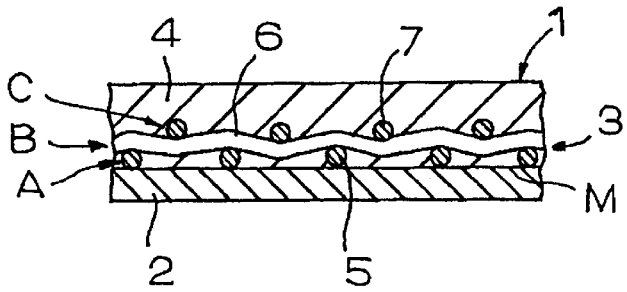

FIGS. 2 (*a*) and (*b*) show the relationship between the yarn 5 of the inner layer A, the yarn 6 of the middle layer B, and the yarn 7 of the outer layer C. FIG. 2(*a*) is a cross-sectional view as viewed from the plane of the line A—A of FIG. 1 and FIG. 2(*b*) is a cross-sectional view as viewed from the plane of the line B—B of FIG. 1. As is evident from these drawings, the yarn 5 of the inner layer A and the yarn 7 of outer layer C functions to reinforce the belt 1 in accordance with the present invention in the direction of MD and to crimp (K) the yarn 6 of the middle layer B with the yarns 5 and 7.

Also, the yarn 6 of middle layer B reinforces the belt 1 in accordance with the present invention in the direction of CMD and improves flexibility to bending at the edges of the shoe in the direction of CMD because it is crimped (K). Also, since the crimped yarn 6 of the middle layer B is positioned nearly at the center of the cross section of the base material layer 3, stabilizes the center of bending in the direction of CMD and the obverse resin layer 2 and the reverse resin layer 4 have a function of reducing stress caused by a difference in curvature.

Figure 3:
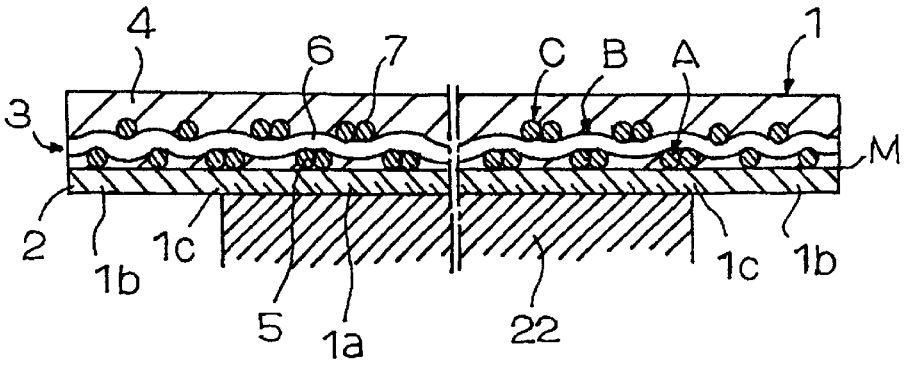
FIG. 3 is a fragmentary cross-sectional view of a belt in accordance with the present invention as viewed along a section line in the direction of CMD in the case where the inner layer and the outer layer of the base material layer of the belt has a single yarn in one part and two side by side yarns in the other part.

The number of windings of the yarn 5 of the inner layer A and the number of windings of the yarn 7 of the outer layer C can be determined according to the size of the yarn and the strength of the yarn, or to shorten a time for winding them. Also, as shown in FIG. 3, the number of grouped (side by side) winding of yarn 5 and the number of grouped (side by side) winding of yarn 7 may be increased (to two in the drawing) in a portion 1*a* contacting a shoe 22(densely hatched portion) and at the boundary portions 1*c* between the portion 1*a* and portions 1*b* not contacting the shoe 22. On the other hand, the number of yarn windings 5 and the number of yarn windings 7 in each grouping may be decreased (to one in the drawing) at the portions 1*b* not contacting the shoe 22 at both end portions of the belt 1 in accordance with the present invention.

The adjustment of the number of yarn windings is also important as a means for producing base material characteristics to be required in the case where the first resin layer 2 and the second resin layer 4 are different in thickness and in bending characteristics from each other.

Figure 4:
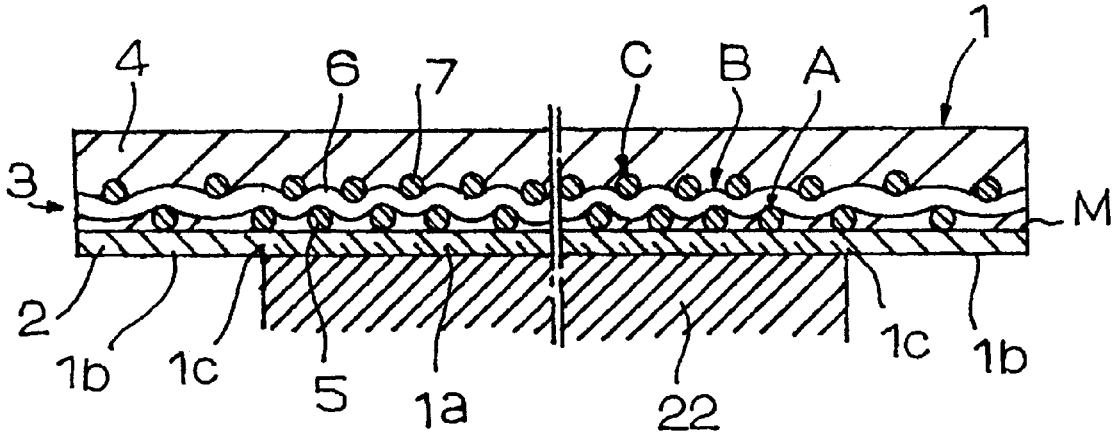
FIG. 4 is a fragmentary cross-sectional view of a belt in accordance with the present invention as viewed along a section line running in the direction of CMD in the case where the inner layer and the outer layer of the material layer of the base belt are changed in the density of yarns.

The winding density (pitch) of the yarn 5 of the inner layer A and that of the yarn 7 of the outer layer 7 can suitably be determined according to the size and the strength of the yarn. Also, as shown in FIG. 4, the winding densities (pitches) of the yarns 5 and 7 may be increased in the portion 1*a* contracting the shoe 22 (densely hatched portion) and at the boundary portions 1*c* between the portion 1*a* and the portions 1*b* not contacting the shoe 22 (i.e., in these areas the the interval or pitch of the winding is reduced) to produce high bending strength and tensile strength in the direction of MD. On the other hand, the densities of the yarns 5 and 7 may be decreased (the interval or pitch of the yarn is increased in these areas) in the portions 1*b* not contacting the shoe 22 at both end portions of the belt 1 in accordance with the present invention.

The number and the density (pitch) of the crimped (K) yarn 6 of the middle layer B can suitably be determined according to the size and the strength of the yarn so as to ensure strength in the direction of CMD.

The yarns 5, 6 and 7 constituting the layers A, B and C can satisfactory be made of a synthetic fiber such as nylon, polyester, aromatic polyester having high function and high elasticity, aromatic polyamide, aromatic polyamide or polyethylene having high strength. Also, an inorganic fiber such as carbon fiber, glass fiber, or the like can be used. The size of the fiber (yarn) may be a monofilament or a multifilament having a diameter of 0.3 mm to 1.0 mm, or a twist yarn thereof.

Next, the manufacturing process of the belt 1 in accordance with the present invention will be described. First, as shown in FIG. 5 (*a*), a separating agent (not shown) is applied to the ground surface of a mandrel 8 rotatable around an axis 8*a*, or a separating sheet (not shown) is placed on the ground surface, and then resin is applied thereon to a thickness of about 0.5 mm to 2 mm by the use of a coater 9 (doctor bar or a coater bar) to form the first resin layer 2.

Figure 5A:
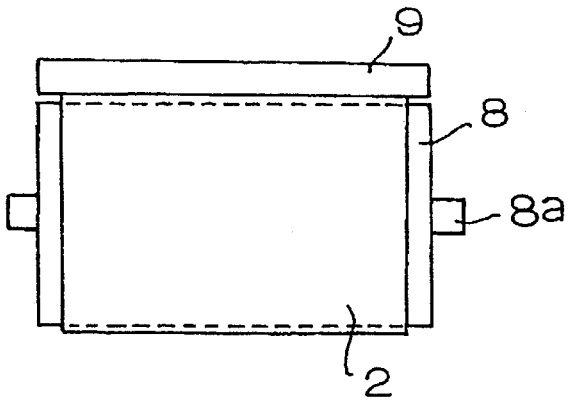
FIGS. 5 (*a*), (*b*) and (*c*) are illustrations showing first process steps for manufacturing a belt in accordance with the present invention.
Figure 5B:
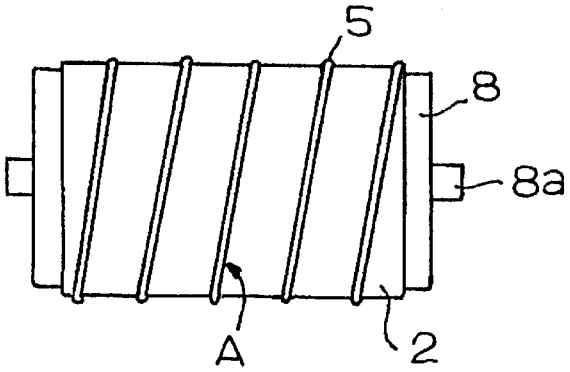
Figure 5C:
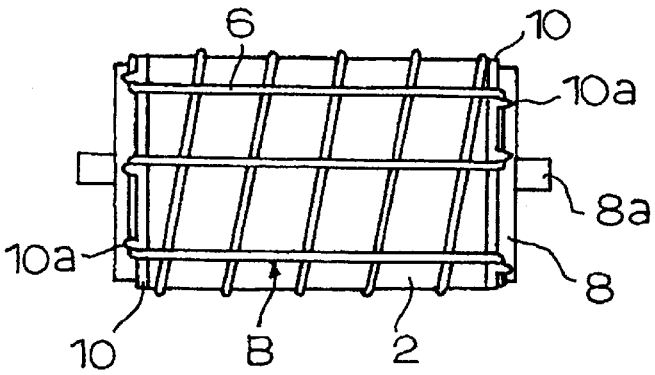

Next, as shown in FIG. 5 (*b*) the yarn 5 is wound spirally on the first resin layer 2 in the circumferential direction to form the base material inner layer A. The winding pitch can be determined on an arbitrary pitch, and may be common or changed in the range in the axial direction of the mandrel 8.

Then, as shown in FIG. 5(*c*), the yarn 6 is arranged on the base material inner layer A nearly parallel to the axial direction (in the direction of CMD) to form the base material middle layer B. In this case, in the present preferred embodiment, ring-shaped clamps 10 are fitted on both ends in the axial direction of the mandrel 8 and retaining projections 10*a* formed on the ring-shaped clamps 10 are used.

Figure 6A:
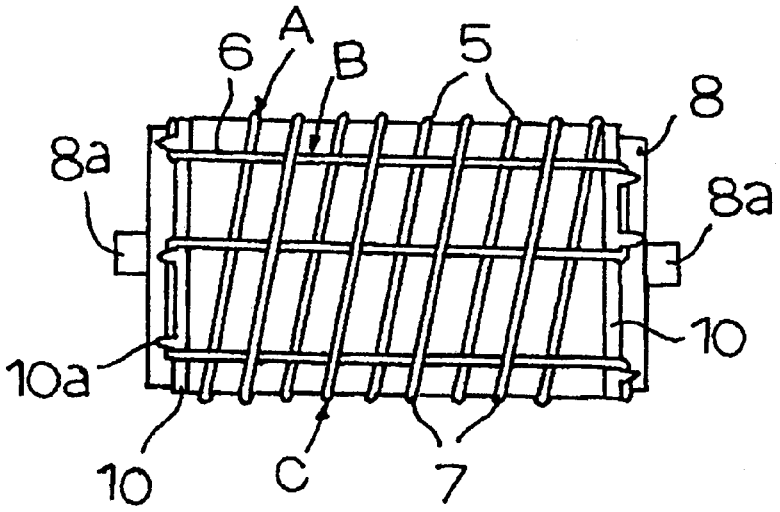
FIGS. 6(*a*) and (*b*) are illustrations showing latter process steps for manufacturing a belt in accordance with the present invention.
Figure 6B:
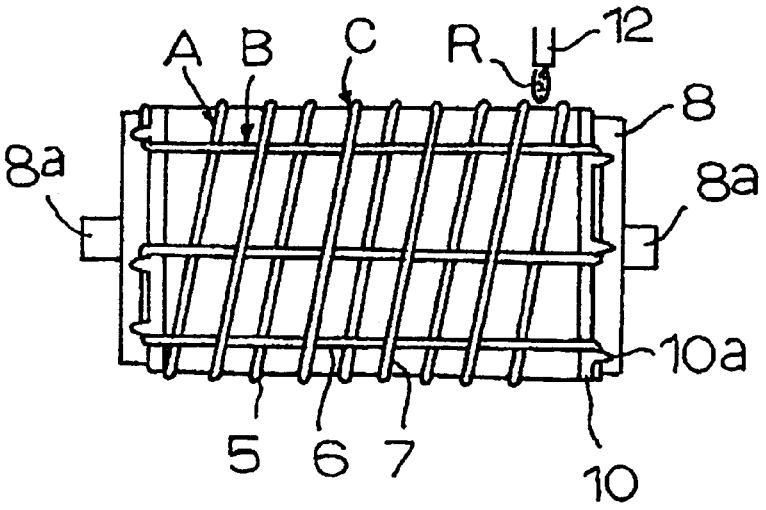

Next, as shown in FIG. 6 (*a*), the yarn 7 is wound spirally on the base material middle layer B in the circumferential direction to form the base material outer layer C. In this case, it is necessary for crimping the yarn 6 to wind the yarn 7 in such a way that it does not overlap the yarn 5 of the base material inner layer A.

Figure 7:
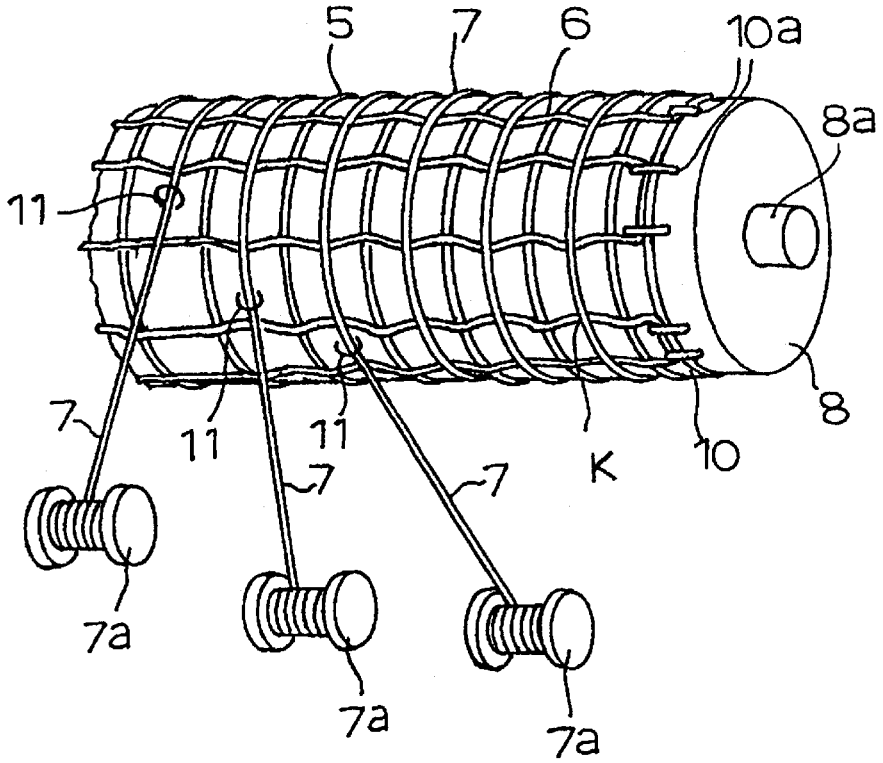
FIG. 7 is a perspective view showing a state in which a yarn of the outer layer of the base material layer of a belt in accordance with the present invention is wound while crimping the yarn of the middle layer.
Figure 8:
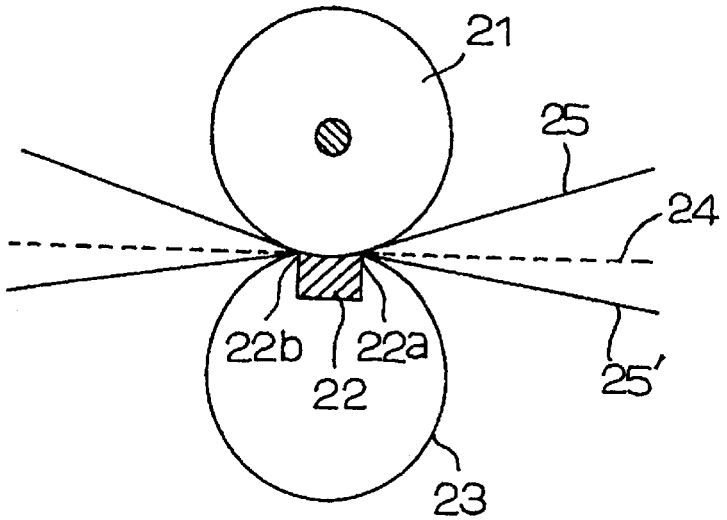
FIG. 8 is a schematic view of a closed-type shoe press.
Figure 9:
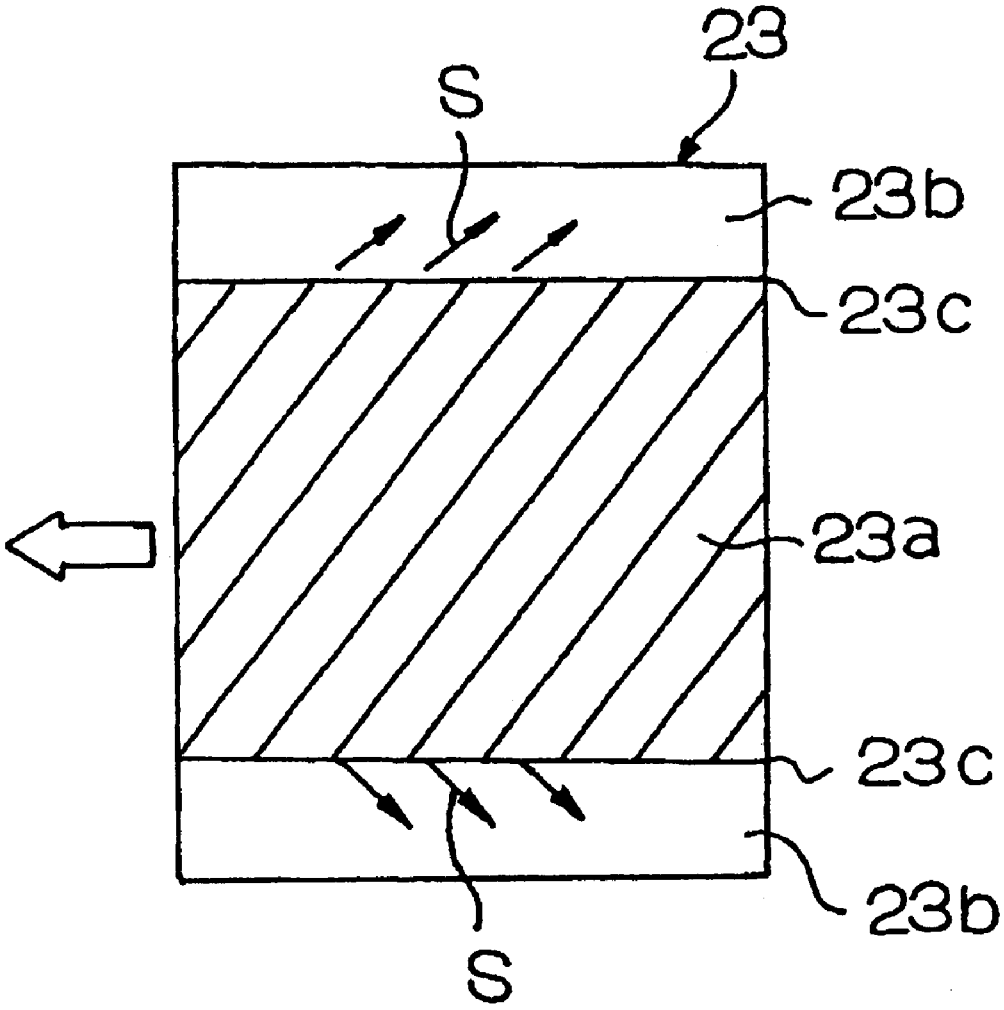
FIG. 9 is a plan view showing a portion of a closed-type shoe press belt on which a shoe is pressed and portions thereof on which the shoe is unpressed.

The yarn 7 is wound on the yarn 6 of the middle layer B while it is being unwound from bobbins 7*a* and being guided by guide rings 11, as shown in FIG. 7. It is because it is intended to wind the yarn 7 on the yarn 6 with a uniform contact force that the guided ring 11 is used. This can make the yarn 6 crimp uniformly (K).

When the base material layer 3, made of a composite layer of the base inner layer A, the middle layer B, and the outer layer C, is formed, a resin material R is supplied to the base material layer 3 from a nozzle 12 to form the second resin layer 4. The second resin layer 4 penetrates the base material layer 3 and joins to the outer surface of the first resin layer 2 at a joint M. In order to improve the joining effect at the joint M to the first resin layer 2, it is also recommended that a primer or a adhesive be previously applied to the outer surface of the first resin layer 2.

As described above, after the second resin layer 4 is formed and cured, it is ground to a desired thickness or, if necessary, is grooved on the surface (belt surface) and then the belt 1 in accordance with the present invention is separated from the mandrel 8. In order to easily separate the belt 1 in accordance with the present invention the mandrel 8, as described above, sometimes the separating agent is previously applied to the surface of the mandrel 8 or the separating sheet is previously placed theron. Also, it is also recommended that hydraulic pressure be used or the expansion or the contraction of the resin be used as a separating method.

EXAMPLE 1

A separating agent (KS-61: made by Shinetsu Chemical Corp.) was applied to the ground surface of a mandrel 8 having a diameter of 1.5 m and then thermosetting urethane (prepolymer: aziprene L100 made by Uniroyal Corp., curing agent 3,3' dichloro 4.4' diamino phenyl methane, 90°, JIS-A) was applied to the separating agent to a thickness of 1 mm with a doctor bar arranged in parallel to a mandrel 8 to form a first resin layer 2 and the first resin layer 2 was heated and cured.

Next, a polyester multifilament yarn 5 of 4000 d was wound spirally on the outer periphery of the first resin layer 2 in the direction of MD by winding 13 turns per 5 cm to form a base material inner layer A and then a Kevlar multifilament yarn 6 of 4000 d was arranged generally parallel to the shaft of the mandrel 8 by placing 10 runs per 5 cm to form the base material middle layer B. Next, in order to crimp the yarn 6 of the middle layer B, a polyester multifilament yarn 7 of 4000 d was wound spirally on the outer periphery of the wound yarn 6 in the direction of MD by the same number of turns as the base material inner layer A (13 turns per 5 cm) and shifted a half pitch to form the base material outer layer C.

Then, a thermosetting urethane resin was applied to and impregnated into a base material layer 3 to form a second resin layer 4 having a thickness of about 5 mm and then the second resin layer 4 was heated and cured at 100° C. or 5 hours and then was ground to a thickness of 5.5 mm, and finally, was grooved in the direction MD with rotary teeth to form a belt 1 in accordance with the present invention (Example 1).

EXAMPLE 2

A first resin layer 2 was formed by using the same device and the same resin as was used in Example 1, and then two strands of polyester multifilament yarn 5 of 2000 d were wound spirally in the direction of MD by placing 26 turns (total, in group of two) per 5 cm to form a base material inner layer A. Next, a Kevlar multifilament yarn 6 of 4000 d was arranged on the inner layer A generally in parallel to the shaft of the mandrel by placing 10 pieces per 5 cm to form a base material inner layer B. Then, in order to crimp the yarn 6, two strands of polyester multifilament yarn 7 of 2000 d were wound spirally on the yarn 6 in the direction of MD by placing 26 turns (total, in groups of two) per 5 cm, as is the case with the base material inner layer A, being shifted a half pitch from the layer A, to form the base material outer layer C.

Then, a thermosetting urethane resin was applied to and impregnated into the base material layer to form a second resin layer 4 having a thickness of about 5 mm, and then the second resin layer 4 was heated and cured at 100° C. for 5 hours and then was ground to a thickness of 5.5 mm, and finally, was grooved in the direction MD with rotary teeth to form a belt 1 in accordance with the present invention (Example 2).

EXAMPLE 3

A first resin layer 2 was formed by using the same device and the same resin as was used in the embodiment 1, and then two strands of polyester multifilament yarn 5 of 4000 d were wound spirally in the direction of MD on the first resin layer 2 in the range of a shoe width plus 10 cm the right and left by placing 20 turns (total, in groups of two) per 5 cm and a polyester multifilament yarn 5 of 4000 d was wound spirally in the direction of MD in portions other than the range described above, that is, in portions corresponding to the end portions of the belt end, by placing 10 turns per 5 cm to form a base material inner layer A. Next, a Kevlar multifilament yarn 6 of 4000 d was arranged on the inner layer A in parallel to the shaft of the mandrel by placing 10 pieces per 5 cm to form a base material middle layer B.

Then, in order to crimp the yarn 6 of the middle layer B, two strands of polyester multifilament yarn 6 of 4000 d were wound spirally in the direction of MD on the middle layer B in the range of a shoe width plus 10 cm to the right and left by placing 20 turns (total, in groups of two) per 5 cm, shifted a half pitch from the yarn 5 of the inner layer A, by the method used for constituting the inner layer A, and a single strand of polyester multifilament yarn of 4000 d was wound spirally in the direction of MD in portions other than the range described above, that is, in portions corresponding to the end portions of the belt, by placing 10 turns per 5 cm shifted a half pitch from the inner layer A to form the base material outer layer C.

Then, a thermosetting urethane resin was applied to and impregnated into the base material layer 3 to form a second resin layer 4 having a thickness of about 5 mm, and then the second resin layer 4 was heated and cured at 100° C. for 5 hours and then was ground to a thickness of 5.5 mm, and finally, was grooved in the direction MD with rotary teeth to form a belt 1 in accordance with the present invention (Example 3).

EXAMPLE 4

A first resin layer 2 was formed by using the same device and the same resin as was used in Example 1, and then three strands of polyester multifilament yarn 5 of 4000 d were wound spirally in the direction of MD on the first resin layer 2 at equal intervals with 15 turns (total, in groups of three) per 5 cm to form a base material inner layer A in a shorter time in Example 1. Next, a Kevlar multifilament yarn 6 of 4000 d was arranged on the layer A in parallel to the shaft of mandrel with 10 pieces per 5 cm to form a base material middle layer B.

Then, in order to crimp the yarn 6 of the middle layer B, three strands of polyester multifilament yarn 6 were wound spirally in the direction of MD on the yarn 6 of the middle layer B at equal intervals with 15 turns (total, in groups of three) per 5 cm and shifted by a half pitch to the yarn 5 of the inner layer A. A guide ring such as 11 was used to shift the timing of contacting the yarn of the middle layer B as shown in FIG. 7 so as to form the base material outer layer C.

Further, a thermosetting urethane resin was applied to and impregnated into the base material outer layer C to form a second resin layer 4 having a thickness of about 5 mm and then the second resin layer 4 was heated and cured at 100° C. for 5 hours and then was ground to a thickness of 5.5 mm, finally, was grooved in the direction of MD with rotary teeth to produce a belt 1 in accordance with the present invention (Example 4).

COMPARATIVE EXAMPLE 1

A separating agent (KS-61: made by Shinetsu Chemical Corp.) was applied to the ground surface of a mandrel 8 having a diameter 1.5 m and then thermosetting urethane (prepolymer: aziprene L1OO made by Uniroyal, Corp., curing agent 3.3' dichloro 4.4' diamino phenylmethane, 90°, JIS-A) was applied to the separating agent to a thickness of 1 mm with a doctor bar arranged in parallel to the mandrel 8 to form a first resin layer 2 and the first resin layer 2 was heated and cured.

Next, a fabric woven in an endless shape by using polyester multifilament yarns of 4000 d as warps and wefts was wound on the first resin layer 2 and then was coated with the same thermosetting urethane resin a described above to a thickness of about 5 mm and was ground to a thickness of 5.5 mm, and then was grooved in the circumferential direction with rotary teeth to produce a comparative belt.

Repetition tests for comparison were conducted for the belts 1 in accordance with the present invention (Examples 1–4 described above) and the comparative belt with a bending test machine, and it was found that the comparative belt introduced cracks at the shoe edge after 700,000 bending and that none of the Examples 1–4 introduced any abnormal conditions even after 1,000,000 bending. This is ascribed to the following firstly, the belt 1 in accordance with the present invention has a base material structure responsive to compression and tension in the direction of CMD; secondly, the flexibility of the crimped yarn of the middle layer to the bending at the shoe edge in the direction of CMD is improved by the yarn of the outer layer and the yarn of the inner layer, thirdly, since the crimped yarn of the middle layer is positioned at the center of the cross section of the base material layer, the center of bending in the direction of CMD is stabilized and hence expansion and contraction produced in the obverse and reverse resin layers by the difference in curvature between the base material layers are not concentrated only on the one side thereof.

As described above, the present invention is formed of a first resin layer formed on a mandrel, a base material layer formed on the outer periphery of the first resin layer, and a second resin layer including the base material layer, wherein the base material layer is formed of a composite layer including an inner layer in which a yarn is wound spirally on the first resin layer in the circumferential direction (in the direction of MD=in the direction in which a belt runs), a middle layer in which a yarn is arranged on the inner layer nearly parallel relationship to the axial direction of the mandrel (in the direction of CMD), and an outer layer in which a yarn is wound spirally on the middle layer in the ciurcumferential direction in such a way that it does not overlap the yarn of the inner layer and crimps the yarn of the middle layer. Therefore, the present invention can have an excellent effect of reducing stress on the resin and of preventing cracks from being produced in the belt contacting the ends of a shoe.

Also, the present invention may have the pitches of the yarns wound in the circumferential direction of the inner layer and the outer layer constituting the base material layer change across the width of the belt. Therefore, the present invention can have the effect of improving the bending and tension characteristics of the base material not only at the portions contacting the shoe, but also at the boundary portions between the portion contacting the shoe and the end portions not contacting the shoe.

Further, since the present invention may have the number of the yarns wound in the circumferential direction of the inner layer and the outer layer constituting the base material layer is one or more than one, it can have an effect of producing high bending strength and tension in the direction of MD by increasing the density of the yarn in the portion contacting the shoe and at the boundaries between the portion contacting the shoe and the end portions not contacting the shoe.

Still further, the present invention may be made with a first resin layer formed on the ground surface of a mandrel, a base material inner layer formed by winding a yarn on the first resin layer spirally in the circumferential direction, a base material middle layer formed by arranging a yarn on the inner layer in nearly parallel relationship to the axial direction of the mandrel and a base outer layer formed by winding a yarn spirally in the circumferential direction in such away that it does not overlap the yarn of the inner layer and crimps the yarn of the middle layer, and a second resin layer formed on the base material composite layer such that it envelopes the whole composite layer. Therefore, the present invention can provide for easy manufacturing a shoe press belt which improves flexibility in bending in the direction of CMD, stabilizes the center of curvature in the direction of MD and in the direction of CMD and reduces stress to the resin.

Still further, since the present invention may have the pitches of the yarns wound in the circumferential direction of the inner layer and the outer layer constituting the base material layer change along the width of the belt, a shoe press belt capable of improving the bending and tensile strength characteristics of the base material in the portion contracting the shoe at the boundary portions between the portion contacting the shoe and the portion not contacting the shoe can be easily manufactured.

Still further, since the present invention may be made with the number of the yarns simultaneously wound in the circumferential direction of the inner layer and the outer layer constituting the base material layer be one or more than one, manufacturing efficiency may be realized in making a shoe press belt capable of producing high bending strength and tension in the direction of MD, by increasing the density of the yarn in the portion contacting the shoe and at the boundary portions between the portion contacting the shoe and the portion not contacting the shoe.

Preferred embodiments of the invention have been described in substantial detail. Many modifications and variations within the scope of the invention will be apparent to those skilled in the art. Therefore the invention should not be limited to the embodiments described.

We claim:

1. A shoe belt comprising a first resin layer formed on a mandrel, a base material layer formed on the outer periphery of the first resin layer, and a second resin layer including the base material layer, characterized in that the base material layer is formed of a composite layer including an inner layer in which at least one strand of yarn is wound spirally on the first resin layer in the circumferential direction, a middle layer in which at least one strand of yarn is arranged on the inner layer nearly parallel to the axial direction of mandrel, and an outer layer in which at least one strand of yarn is wound spirally on the middle layer in circumferential direction in such a way that it does not overlap the yarn of the inner layer and crimps the yarn of the middle layer.

2. A shoe press belt as claimed in claim 1, wherein pitches of the yarn windings wound in the circumferential direction of at least one of the inner layer and outer layer constituting the base material layer change over the width of the belt.

3. A shoe press belt as claimed in claim 1, wherein the number of strands of yarn wound in the circumferential direction of at least one of the inner layer and outer layer constituting the base material layer is more than one.

4. A method of manufacturing a shoe press belt, said method comprising the steps of: forming a first resin layer on a mandrel; forming a base material inner layer by winding at least one strand of yarn on the first resin layer spirally in the circumferential direction; forming a base material middle layer by arranging at least one strand of yarn on the inner layer in nearly parallel to the axial direction of the mandrel; forming a base material outer layer by winding at least one strand of yarn spirally in the circumferential direction in such a way that it does not overlap the yarn of the inner layer and crimps the yarn of the middle layer; and forming a second resin layer on a base material composite layer in such a way that it includes the whole composite layer.

5. The method of manufacturing a shoe press belt as claimed in claim 4, wherein pitches of the yarn windings wound in the circumferential direction of the inner layer and the outer layer constituting the base material layer change over the width of the belt.

6. A method of manufacturing a shoe press belt as claimed in claim 4, wherein the number of strands of yarn wound in the circumferential direction of at least one of the inner layer and the outer layer constituting the base material layer is more than one.

* * * * *